US007144277B2

(12) United States Patent
Pan et al.

(10) Patent No.: US 7,144,277 B2
(45) Date of Patent: Dec. 5, 2006

(54) ELECTRICAL CONNECTOR WITH GUIDANCE FACE

(75) Inventors: Weihua Pan, Kunsan (CN); Ming zhang, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/148,123

(22) Filed: Jun. 7, 2005

(65) Prior Publication Data

US 2006/0052008 A1 Mar. 9, 2006

(30) Foreign Application Priority Data

Sep. 9, 2004 (CN) ..... 2004 2 0794883

(51) Int. Cl.
*H01R 24/00* (2006.01)

(52) U.S. Cl. ..... 439/660; 439/74; 439/374

(58) Field of Classification Search ..... 439/660, 439/74, 374, 377
See application file for complete search history.

(56) References Cited

U.S. PATENT DOCUMENTS 5,161,985 A * 11/1992 Ramsey ..... 439/74
5,176,541 A * 1/1993 Mori ..... 439/736
5,224,866 A * 7/1993 Nakamura et al. ..... 439/81
5,277,597 A * 1/1994 Masami et al. ..... 439/83
5,641,290 A * 6/1997 Yagi ..... 439/74
5,772,474 A * 6/1998 Yagi et al. ..... 439/660
5,830,018 A * 11/1998 Simmel ..... 439/660
5,836,773 A * 11/1998 McHugh et al. ..... 439/74
5,842,875 A * 12/1998 Yagi ..... 439/74
5,876,217 A * 3/1999 Ito et al. ..... 439/74
5,882,212 A * 3/1999 McHugh et al. ..... 439/74
5,885,092 A * 3/1999 Ito et al. ..... 439/74
5,904,581 A * 5/1999 Pope et al. ..... 439/74
5,915,976 A * 6/1999 McHugh ..... 439/74
5,921,787 A * 7/1999 Pope et al. ..... 439/74
5,928,003 A * 7/1999 Kajinuma ..... 439/74
5,931,689 A * 8/1999 Patel ..... 439/346
5,975,916 A * 11/1999 Okura ..... 439/74
6,010,370 A * 1/2000 Aihara et al. ..... 439/660
6,019,613 A * 2/2000 Kataoka et al. ..... 439/83
6,024,608 A * 2/2000 Azuma et al. ..... 439/660
6,099,359 A * 8/2000 Yamamuro ..... 439/736
6,106,306 A * 8/2000 Koga et al. ..... 439/74
6,132,258 A * 10/2000 Kajinuma ..... 439/660
6,155,886 A * 12/2000 Koseki et al. ..... 439/736
6,159,021 A * 12/2000 Kusuhara ..... 439/74
6,179,632 B1 * 1/2001 Wu et al. ..... 439/83
6,257,900 B1 * 7/2001 Huang et al. ..... 439/74
6,276,942 B1 * 8/2001 Hsiao ..... 439/74
6,296,524 B1 * 10/2001 Goto ..... 439/660
6,336,829 B1 * 1/2002 Matsukawa ..... 439/660

(Continued)

*Primary Examiner*—Ross Gushi
(74) *Attorney, Agent, or Firm*—Wei Te Chung

(57) ABSTRACT

An electrical connector (1) for mating with a mating connector includes an insulating housing (10), a number of electrical contacts (20) received in the housing (10). The housing (10) has a mating face (11), a mounting face (12), two opposite side walls (13) for connecting the mating face and the mounting face, a receiving space (15) depressed in the mating face is formed between the side walls. A guidance face (17) is formed on the inner face (131) of the sidewalls extending from the mating face to the deep-lever of the receiving space, which includes an arc face (171) and a slant face (172) tangent to the arc face. Each contact has a contact face (221) exposed to the receiving space.

13 Claims, 4 Drawing Sheets

U.S. PATENT DOCUMENTS 6,371,816 B1 * 4/2002 Fukui ..... 439/660
6,390,828 B1 * 5/2002 Yamaguchi et al. ..... 439/74
6,540,529 B1 * 4/2003 Yu ..... 439/74
6,540,561 B1 * 4/2003 Masumoto ..... 439/660
6,623,308 B1 * 9/2003 Ono ..... 439/680
6,702,624 B1 * 3/2004 Akimoto et al. ..... 439/736
6,729,890 B1 * 5/2004 Shin ..... 439/74
6,733,305 B1 * 5/2004 Pan et al. ..... 439/74
6,764,314 B1 * 7/2004 Lee ..... 439/65
6,793,506 B1 * 9/2004 Hirata et al. ..... 439/74
6,811,411 B1 * 11/2004 Hirata et al. ..... 439/74
6,827,588 B1 * 12/2004 Huang et al. ..... 439/74
6,843,677 B1 * 1/2005 Fukuda ..... 439/374
6,846,187 B1 * 1/2005 Yu ..... 439/74
6,866,522 B1 * 3/2005 Terashima et al. ..... 439/74
6,881,075 B1 * 4/2005 Huang et al. ..... 439/74
6,902,442 B1 * 6/2005 Huang et al. ..... 439/736
6,948,951 B1 * 9/2005 Wu et al. ..... 439/108
2003/0176110 A1 * 9/2003 Wu et al. ..... 439/660
2004/0018756 A1 * 1/2004 Pan et al. ..... 439/74
2004/0058568 A1 * 3/2004 Ye et al. ..... 439/74
2004/0072465 A1 * 4/2004 Murakami ..... 439/374
2004/0102065 A1 * 5/2004 Obikane et al. ..... 439/74
2004/0142586 A1 * 7/2004 Yu ..... 439/74
2004/0157478 A1 * 8/2004 Midorikawa et al. ..... 439/74
2004/0253848 A1 * 12/2004 Huang et al. ..... 439/74
2005/0032438 A1 * 2/2005 Huang et al. ..... 439/736
2005/0037642 A1 * 2/2005 Zhang ..... 439/74
2005/0059271 A1 * 3/2005 Zhang ..... 439/74
2005/0101163 A1 * 5/2005 Obikane et al. ..... 439/74
2006/0052008 A1 * 3/2006 Pan et al. ..... 439/660

* cited by examiner

ELECTRICAL CONNECTOR WITH GUIDANCE FACE

BACKGROUND OF THE INVENTION

1. Field of the Invention

The present invention generally relates to an electrical connector and more particularly, to the electrical connector having a plurality of contacts insert molded within and having a guidance face to decrease the possibility of deformation of the contacts under connection force.

2. Description of Related Art

Electrical connectors well known in the art are used in a variety of applications and develop in a tendency of mini-type and integration. Such connectors are provided as a connection between two opposite circuit boards. This type of connectors is referred to in the art as board to board connectors and typically include opposing interengaging male and female connector assembly, each of that has a housing having a plurality of contacts therein. The female connector may typically includes a receiving space for receiving the male connector in a connective relationship. However, a variety of oblique insertion may occur when the male connector is inserting into the female connector. In this condition, if the female connector is short of a good guidance for the contacts of the male connector, the contacts of the male connector will move along a wrong direction and impact with the contacts of the female connector, and this commonly leads to the damage of the contacts and a difficult transmission of signal between the electrical boards.

Hence, an improved electrical connector is desired to overcome the disadvantages and problems of the prior art.

SUMMARY OF THE INVENTION

An object of the present invention is to provide an improved electrical connector having a guidance face for leading a mating connector into the electrical connector.

To achieve the above object, an electrical connector in accordance with the present invention for mating with a mating connector includes an insulating housing, a number of electrical contacts received in the housing. The housing has a mating face, a mounting face, two opposite side walls for connecting the mating face and the mounting face, a receiving space depressed in the mating face is formed between the side walls. A guidance face is formed on the inner face of the sidewalls extending from the mating face to the deep-lever of the receiving space, which includes an arc face and a slant face tangent to the arc face. Each contact has a contacting face exposed to the receiving space. This structure can make the contacts of the mating connector move without any friction so that damage of the contacts is avoided when the mating connector is inserted in, hence an excellent signal transmission between the electrical connectors is ensured.

Other objects, advantages and novel features of the invention will become more apparent from the following detailed description when taken in conjunction with the accompanying drawings.

DETAILED DESCRIPTION OF THE INVENTION

Reference will now be made in detail to the preferred embodiment of the present invention.

Figure 1:
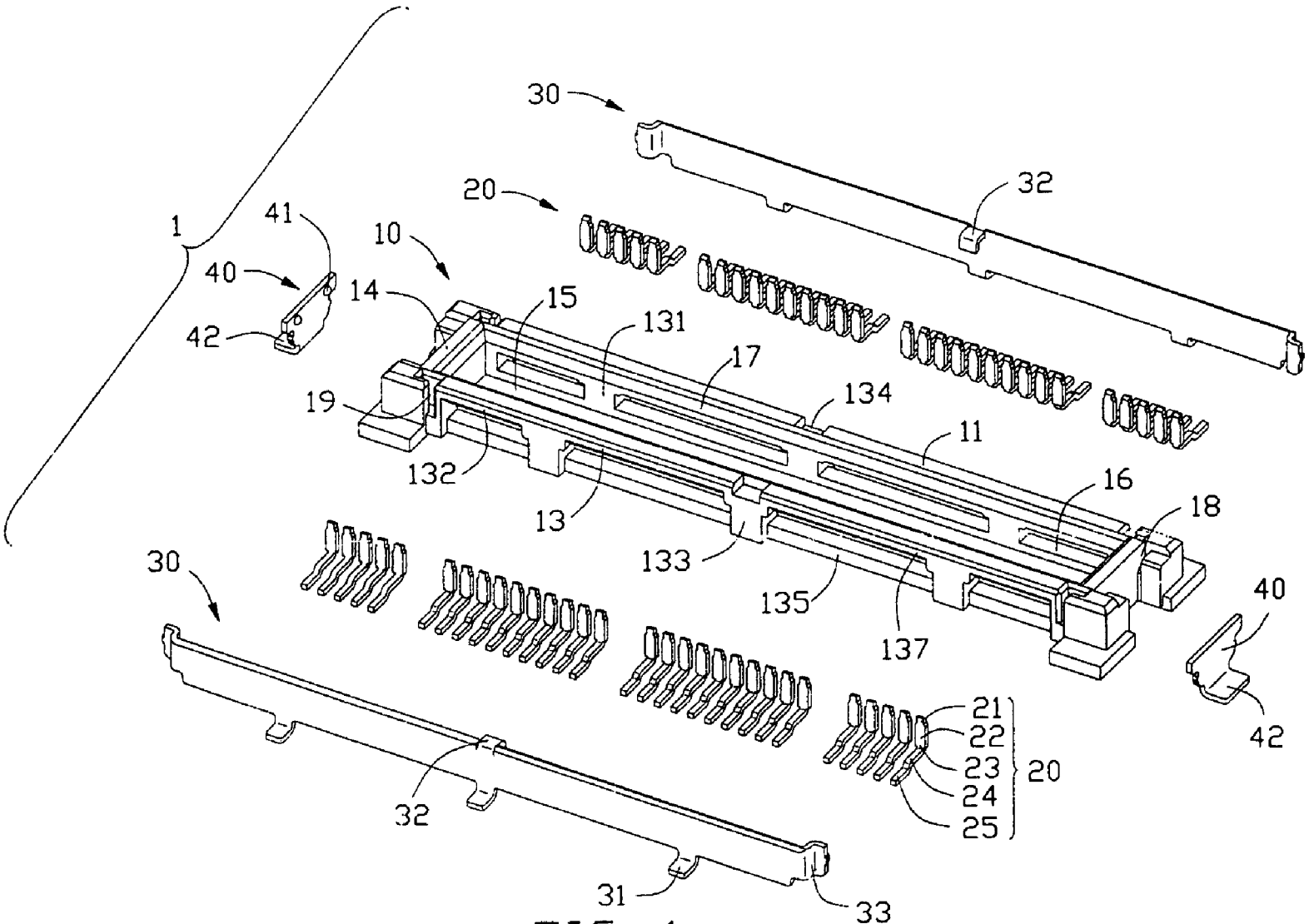
FIG. 1 is an exploded, perspective view of an electrical connector in accordance with the present invention.
Figure 2:
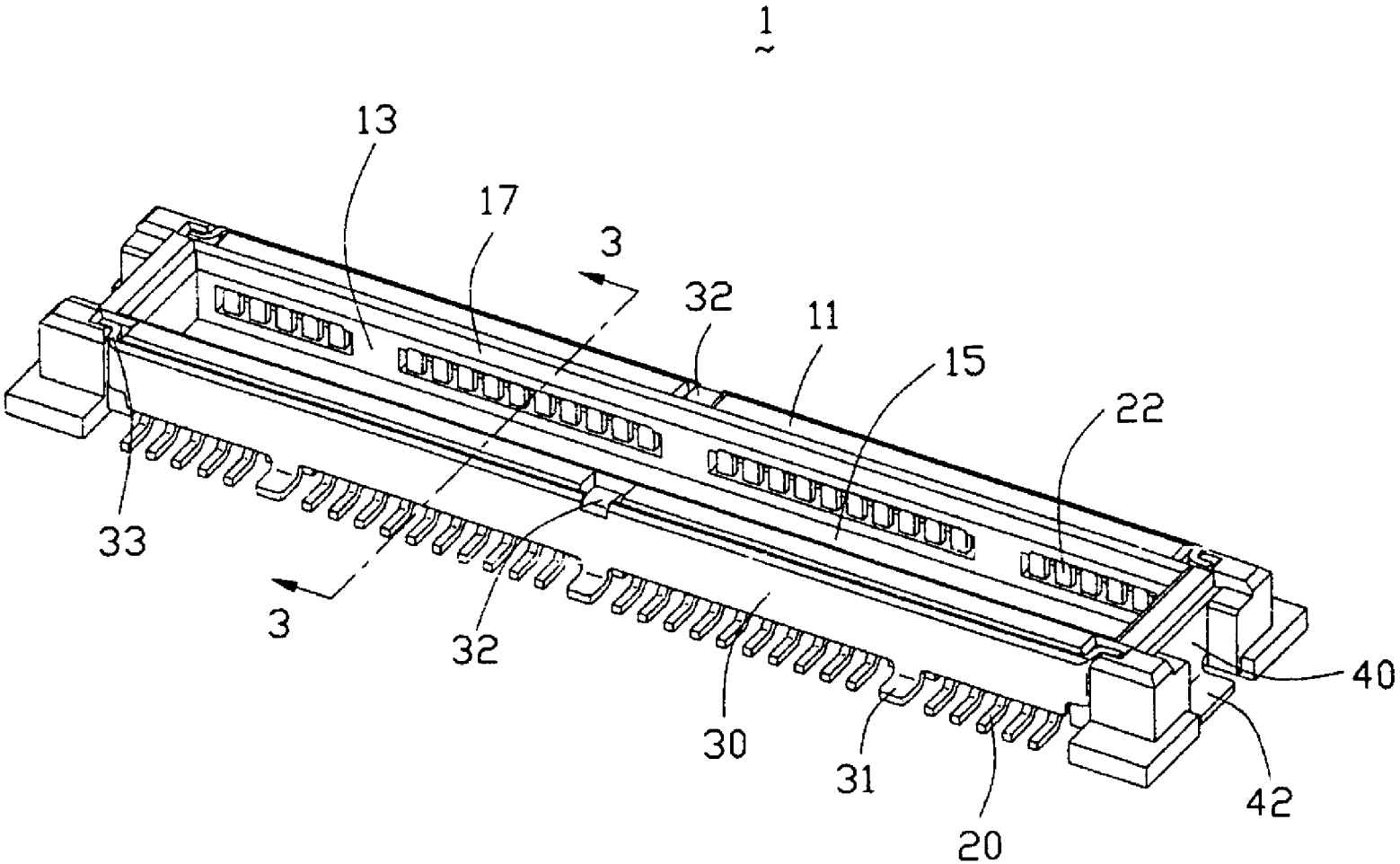
FIG. 2 is an assembled, perspective view of the electrical connector shown in FIG. 1.

Please referring to FIGS. 1–2, an electrical connector 1 is mountable to an printed circuit board (PCB) (not shown) and engagable with a mating connector (not shown). The electrical connector 1 comprises an elongated insulative housing 10, a plurality of electrical conductive contacts 20 received in the housing 10, two shieldings 30 mounted on two sides of the housing 10, and a pair of "L" shaped metal pieces 40 received in two ends of the housing 10.

Figure 3:
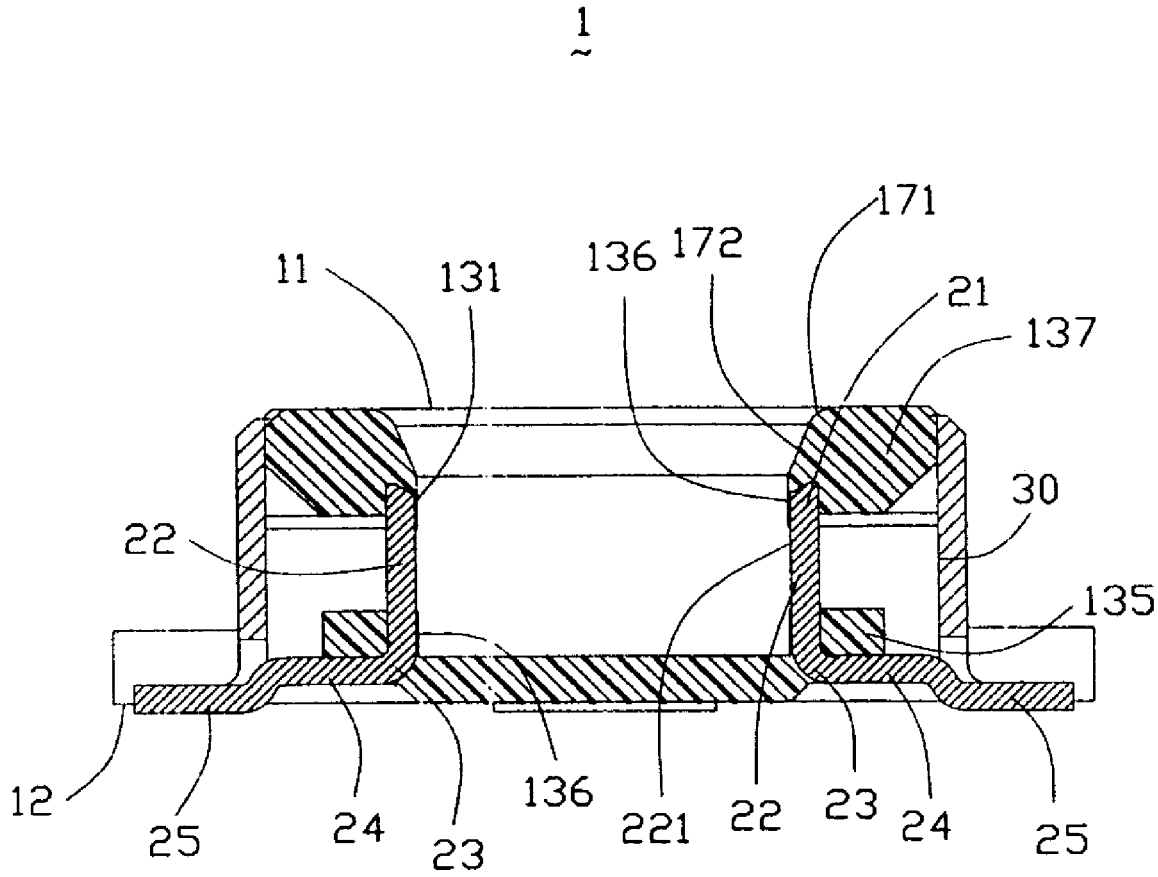
FIG. 3 is a cross-sectional view taken from line 3—3 of FIG. 2.
Figure 4:
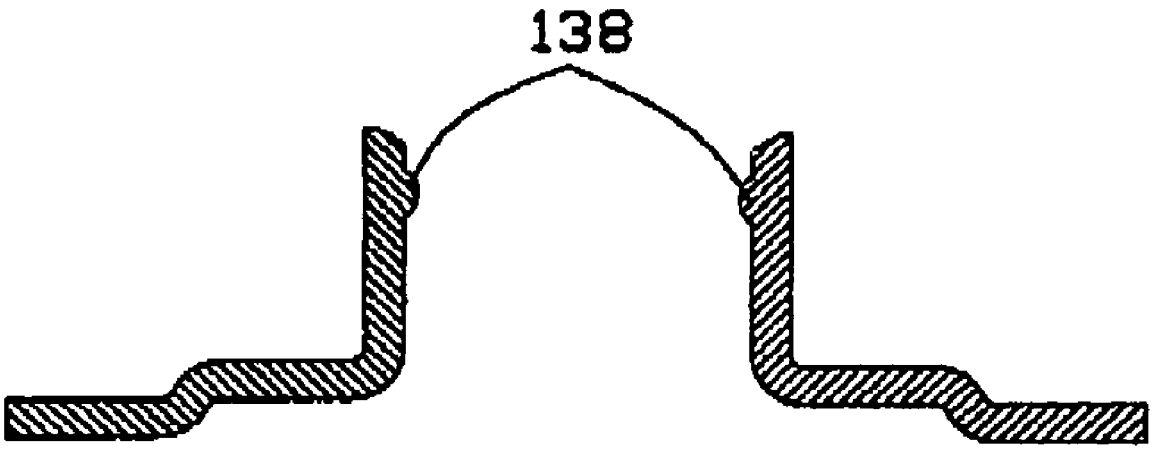
FIG. 4 is a cross-section view of a couple of contacts in other embodiment.

Referring to FIGS. 1–3, the housing 10 made of plastic material has a mating face 11 and a mounting face 12 opposite to the mating face 11, and the housing 10 comprises two opposing elongated sidewalls 13 extending from the mating face 11 to the mounting face 12 and a pair of opposing end walls 14 formed between the mounting face 12 and the mating face 11 and connecting with the sidewalls 13. An elongate receiving space 15 is depressed in the mating face 11 and defined between the sidewalls 13 and the end walls 14. Each sidewall 13 has an inner surface 131 composed by a guidance face 17 and an upright face 136 connected with the guidance surface 17, and an outer surface 132. The guidance surface 17 extending from the mating face 11 to a deep-lever of the receiving space 15 comprises an arc face 171 and a slant surface 172 tangent to the arc face 171. In the process of the mating connector mated with the connector 1, the arc face 172 can lead contacts (not shown ) of the mating connector into the receiving space 15 of the connector 1, and the slant face 172 tangent to the arc face 171 can further lead smoothly the contacts of the mating connector into the receiving space 15 of the housing 10. Even the mating connector is obliquely inserted into, the contacts of the mating connector can be led into a right position by the guidance face 17. For an excellent guidance of the contacts of the mating connector, a preferred scope of an angle between the slant face and the upright face is from 135 degree to 175 degree, in this embodiment it is 150 degree. Each sidewall defines a plurality of rectangular-holes 16 in a middle therethrough for enhancing the orientation of the contacts 20 insert molded in the housing 10. A plurality of spacing portion 133 are formed between each two adjacent rectangular-holes 16, and each sidewall 13 is divided into an upper sidewall 137 and a lower sidewall 135 by the rectangular-holes 16, an outer surface of the spacing portion 133 is in a same surface with an outer surface of the upper sidewall 137 and protrudes out the lower sidewall 135. The housing 10 defines a pair of first recesses 18 in each end wall 14 and a pair of second recesses 19 in two end of each sidewall 13. A locking recess 134 is formed in a middle of the mating face 11 of each sidewall 13.

Referring to FIG. 1 and FIG. 3, the contacts 20 insert molded with the housing 10 are generally "L" shaped, and each contact 20 comprises a holding portion 21 embedded in the housing 10 completely, a large flat mating portion 22 for engaging with the contacts of the mating connector, a connecting portion 23 embedded in the housing 10 and integrally connected with the mating portion 22, a hanging arm 24 extending perpendicularly from the connecting portion 23, and a mounting portion 25 integrally connected with the hanging arm 24 and mountable to the PCB. The mating portion 22 has a contacting face 221 explored in the receiving space 15. Thereby, the contacts of the mating connector can be guided to contact with the contacting face 221 along the guidance face 17 to the contacting face 221 of the contacts 20 without any friction when the mating connector is inserted in, so that the damage to the contacts of the mating connector and the contacts 20 can be avoided caused by a variety of incorrect insertion of the mating connector.

Each of the shieldings 30 mounted onto corresponding sidewall 132 comprises a plurality of grounding foots 31 extending from a lower edge thereof, a locking piece 32 extending from the opposite edge thereof and two wings 33. The locking piece 32 is engagable with the locking recess 134 of the housing 10. The wings 33 are formed in two ends of the shielding 30 and received in the second recess 19 of the housing 10. The grounding foots are soldered to the PCB on which the connector 1 is mounted.

Each metal piece 40 received in the first recess 18 of the housing 10 has two protrusions 41 thereon and a grounding foot 42 extending perpendicularly from a lower end thereof. The protrusions 41 are used for securely connecting the metal pieces 40 to the housing 10. The grounding foots 42 are soldered on the PCB.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed. Such as each contact has a contacting face recessed in each sidewall and at least one protrusion 138 for engaging with the contacts of the mating connector.

We claim:

1. An electrical connector comprising:

a housing having a mating face, a mounting face opposite to the mating face, and two opposite sidewalls connecting the mating face with the mounting face, a receiving space depressed in the mating face and formed between the two sidewalls, each sidewall having a guidance face formed in an inner surface thereof from the mating face to the deep-lever of the receiving space and the guidance face comprising an arc face and a slant surface tangent to the arc face;

a plurality of contacts received in the sidewalls and each of that comprising a mounting portion projecting out of the mounting face and a mating portion having a contacting face exposed in the receiving space and each contact having at least one protrusion on the contacting face.

2. The electrical connector in accordance wit claim 1, wherein each contact has a holding portion embedded in the housing, the contacting face is recessed in the sidewall.

3. The electrical connector in accordance with claim 1, wherein each contact has a holding portion embedded in the housing.

4. The electrical connector in accordance with claim 3, wherein the contacts are insert molded in the housing.

5. The electrical connector in accordance with claim 4, further comprising two metal pieces, the housing comprises two end walls connected with sidewalls, the metal pieces are mounted on the end walk of the housing respectively.

6. The electrical connector in accordance with claim 5, further comprising at least one shielding mounted on the housing, two wings are formed on two ends of each shielding.

7. The electrical connector in accordance with claim 6, wherein a scope of the angle of the slant face and the upright face is from 135 degree to 175 degree.

8. The electrical connector in accordance with claim 7, wherein each sidewall has a plurality of rectangular-holes therethrough and is divided into an upper sidewall and a lower sidewall by the rectangular-holes, a plurality of spacing portions are formed between each two adjacent rectangular-holes, an outer surface of each spacing portion is in a seine surface with an outer surface of the upper sidewall and protrudes out of the lower sidewall.

9. An electrical connector comprising:

an insulative housing defining two opposite longitudinal walls with a receiving space therebetween;

at least one shielding mounted on the housing, two wings formed on two ends of each shielding;

a curved guiding corner formed on a top portion of each of said longitudinal walls adjacent to said receiving space; and a plurality of contacts disposed in the two opposite longitudinal walls, each of said contacts defining a, mating portion parallel to an inner surface of the corresponding longitudinal wall facing the receiving space; wherein a mating surface of the mating portion of each of said contacts is flush with the corresponding inner surface.

10. An electrical connector comprising:

an insulative housing defining two opposite longitudinal walls with a receiving space therebetween, each wall having a plurality of rectangular-holes, and a plurality of spacing portions being formed between each two adjacent rectangular-holes;

a plurality of contacts disposed in the two opposite longitudinal walls, each of said contacts defining a mating portion parallel to an inner surface of the corresponding longitudinal wall facing the receiving space; and a guidance surface formed on an inner top portion of each of said longitudinal walls adjacent to said receiving space; wherein said guidance surface defines a curve portion starting from a top face of the inner face of the housing downwardly, and a slanted portion extending from a bottom end of the curved portion and terminated at the inner surface of the corresponding longitudinal wall.

11. The electrical connector as claimed in claim 10, wherein said slanted portion is tangent to said curved portion at the bottom end of the curved portion.

12. The electrical connector in accordance with claim 10, each wall is divided into an upper wall and a lower wall by the rectangular-holes.

13. The electrical connector in accordance with claim 10, an outer surface of each spacing portion is in a same surface with an outer surface of the upper wall and protrudes out of the lower wall.

* * * * *